US007913352B2

(12) United States Patent
Ichikawa et al.

(10) Patent No.: US 7,913,352 B2
(45) Date of Patent: Mar. 29, 2011

(54) DUST COLLECTOR

(75) Inventors: Hiroaki Ichikawa, Anjo (JP); Kazunori Tsuge, Anjo (JP); Yoshinori Shibata, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 12/588,913

(22) Filed: Nov. 2, 2009

(65) Prior Publication Data

US 2010/0122427 A1 May 20, 2010

(30) Foreign Application Priority Data

Nov. 18, 2008 (JP) ..... 2008-294678

(51) Int. Cl.
*A47L 9/00* (2006.01)

(52) U.S. Cl. ..... 15/323; 15/327.2; 15/327.6

(58) Field of Classification Search ..... 15/323, 15/327.2, 327.6; *A47L 9/00*
See application file for complete search history.

(56) References Cited

U.S. PATENT DOCUMENTS

| | | | |
|---|---|---|---|
| 2,355,034 | A | 8/1944 | Scott |
| 2,573,091 | A | 10/1951 | Brown, Jr. |
| 2,918,692 | A | 12/1959 | Martinec |
| 5,031,266 | A | 7/1991 | Tillman et al. |
| 2007/0113528 | A1 | 5/2007 | Knuth et al. |

FOREIGN PATENT DOCUMENTS

| | | |
|---|---|---|
| DE | 3440910 A1 | 5/1986 |
| JP | A-62-84731 | 4/1987 |
| JP | B2-3-60256 | 9/1991 |

OTHER PUBLICATIONS

Feb. 19, 2010 Search Report issued in European Patent Application No. 09013717.5.

Extended European Search Report issued in Application No. EP 09 01 3717 on Jun. 21, 2010.

*Primary Examiner* — David A Redding

(74) *Attorney, Agent, or Firm* — Oliff & Berridge, PLC

(57) ABSTRACT

In a dust collector which includes a tank and a main body disposed over the tank, the main body includes a housing and an air intake unit incorporated in the housing. A hook is provided in the housing of the main body, and capable of being manually operated to change a position thereof to one of a retracted position and a pull-out position. The hook in the retracted position is completely embedded in a profile of the housing, and the hook in the pull-out position projects sideward from the housing with a hooked end portion thereof oriented upward. A power tool with its projected portion disposed between the housing and the hook end portion of the hook in the pull-out position can be stably supported on an upper surface of the housing and an upper end of the hook end portion of the hook in the pull-out position.

12 Claims, 7 Drawing Sheets

DUST COLLECTOR

BACKGROUND OF THE INVENTION

This application claims the entire benefit of Japanese Patent Application Number 2008-294678 filed on Nov. 18, 2008, the entirety of which is incorporated by reference.

TECHNICAL FIELD

This invention relates to a dust collector which can be used in combination with a power tool.

BACKGROUND ART

A dust collector known in the art (for example, see JP 3-60256 B) has a main body having an air intake unit formed with a motor-driven intake fan, and a tank having an opening formed at an upper side thereof, which is sealed off from outside with the main body provided over the tank. The tank has an inlet to which a hose or the like may be attached, through which outside air is sucked into the tank by the action of rotating the intake fan. The outside air thus sucked into the tank is filtered by a filter provided between the main body and the opening of the tank, so that dust or the like can be caught and stored in the tank. As well known in the art, this type of dust collector may be used in combination of a power tool, such as a circular saw; that is, with a hose having one end attached to the inlet of the tank and the other end connected to the power tool, the dust collector is driven while the power tool is being operated, so that chips or the like produced by the power tool can be directly collected.

When the dust collector is used in combination with the power tool as described above, the dust collector may also be utilized to temporarily place the power tool thereon when the operation of the power tool is suspended. On this occasion, the power tool is typically placed on an upper side of the main body of the dust collector. However, the upper side of the main body is usually provided with a carrying handle for enhanced portability, as in the dust collector illustrated in JP 3-60256 B, and thus has depressions and projections thereon. Similarly, the power tool may have depressions and projections; for example a circular saw typically has a safety cover protruding down from a base. Accordingly, the power tool would not be stably placed on the main body of the dust collector, and could possibly drop from the dust collector.

Thus, there is a need to provide a dust collector of which a main body has an upper side on which a power tool can be temporarily placed in a stable state and thus provide an improved usability.

The present invention has been made in an attempt to eliminate the above disadvantages, and illustrative, non-limiting embodiments of the present invention may overcome the above disadvantages and other disadvantages not described above.

SUMMARY OF INVENTION

In a first aspect of the present invention, a hook is provided in a housing of a main body of a dust collector. The hook is capable of being manually operated to change a position thereof to one of a retracted position and a pull-out position. The hook in the retracted position is completely embedded in a profile of the housing, and the hook in the pull-out position projects sideward from the housing with a hooked end portion thereof oriented upward.

In a second aspect according to the configuration described above in the first aspect, a plurality of ribs which extend parallel to one another in an upward and downward direction when the hook is in the pull-out position may optionally be provided on an inner surface of the hooked end portion facing toward the housing.

In a third aspect according to the configurations described above in the first and the second aspects, an additional feature for more effectively preventing the power tool temporarily placed on the dust collector from dropping may optionally be provided. More specifically, in the third aspect, for example, the hooked end portion of the hook may have a length such that the hooked end portion is higher than an upper surface of the housing when the hook is in the pull-out position.

In a fourth aspect according to the configurations described above in any one of the first to the third aspect, an additional feature for facilitating the operation of the hook may optionally be provided. More specifically, in the fourth aspect, for example, the housing may be shaped like a box with a flat upper surface, and the hook may have a plate member bent into a shape like a letter L, wherein the plate member has a lower end joined to the main body at a lower portion of a side wall of the housing in a manner that permits the plate member to tilt downward and upward. The hook is of being operated to rotate between the retracted position and the pull-out position.

The following advantageous effects may be expected by implementing the present invention in such a way as described above.

According to the configuration as described in the first aspect, a power tool can be temporarily placed on an upper surface of the main body of the dust collector in a stable state. Therefore, the usability can be increased. Moreover, since the hook can be used to hold accessories such as a hose or a cord, etc., it is also convenient for storing such accessories.

According to the additional feature as described in the second aspect, further advantage may be obtained in addition to that of the first aspect; that is, the hook is reinforced by the ribs, so that the durability of the hook can be increased, and prevention of slipping or dropping of the hose or other accessories held at the inner surface of the hooked end portion of the hook may be expected.

According to the additional feature as described in the third aspect, further advantage may be obtained in addition to that of the first or the second aspect; that is, setting the height (length) of the hooked end portion of the hook appropriately as defined in the third aspect makes it possible to support a power tool in a position with its outer side tilting upward to some extent, such that the potential risk of that the power tool temporarily placed thereon slips off and drops down outside from the main body of the dust collector can be reduced.

According to the additional feature as described in the fourth aspect, further advantage may be obtained in addition to that of any one of the first to the third aspect; that is, the operation for moving (rotating) the hook between the retracted position and the pull-out position can be performed with increased ease.

BRIEF DESCRIPTION OF THE DRAWINGS

The above aspect, other advantages and further features of the present invention will become more apparent by describing in detail illustrative, non-limiting embodiments thereof with reference to the accompanying drawings, in which.

DESCRIPTION OF EMBODIMENTS

Exemplary embodiments of the present invention will be described hereinafter with reference to the accompanying drawings.

Figure 1:
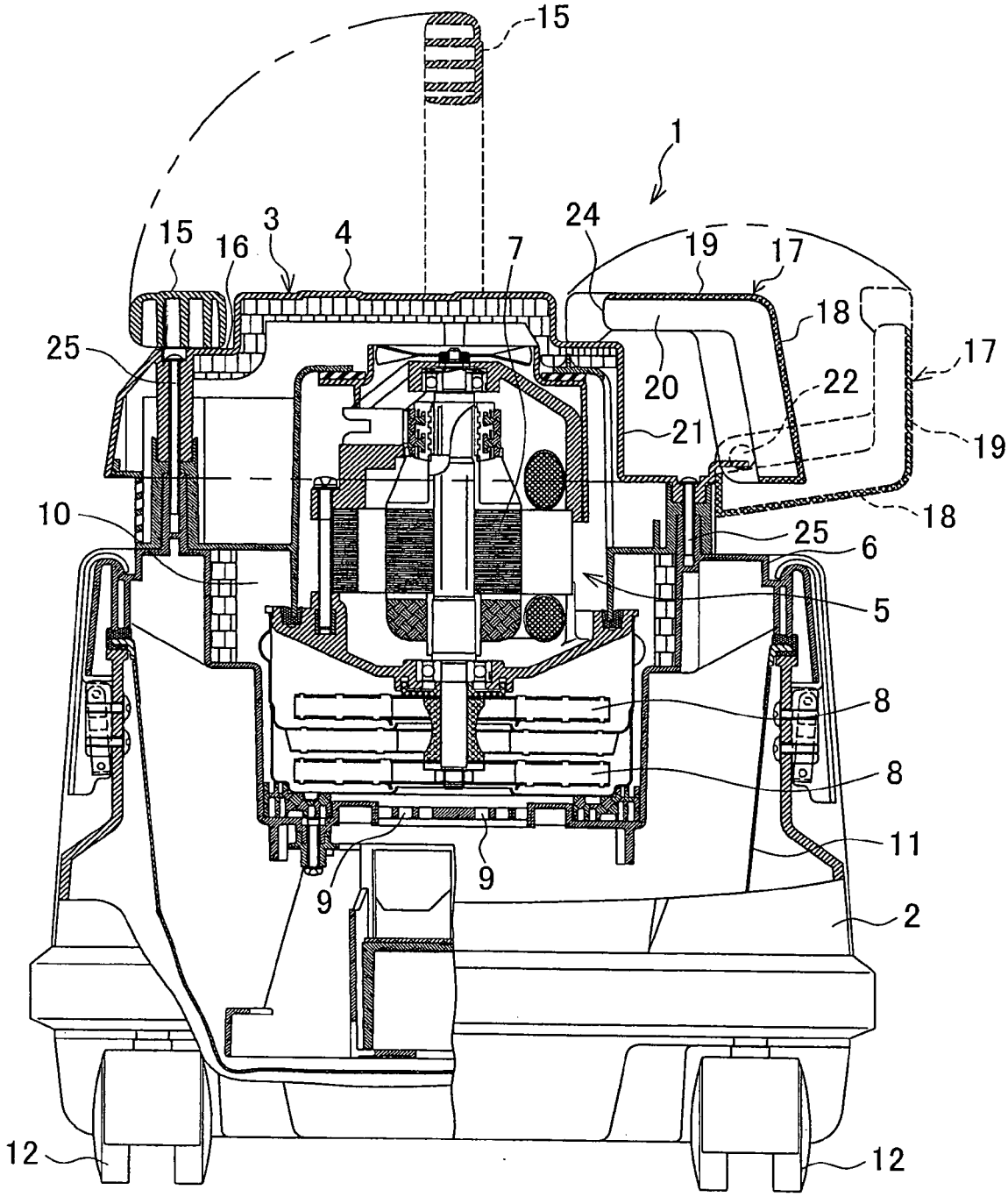
FIG. 1 is a vertical sectional view of a dust collector according to an exemplary embodiment of the present invention.
Figure 2:
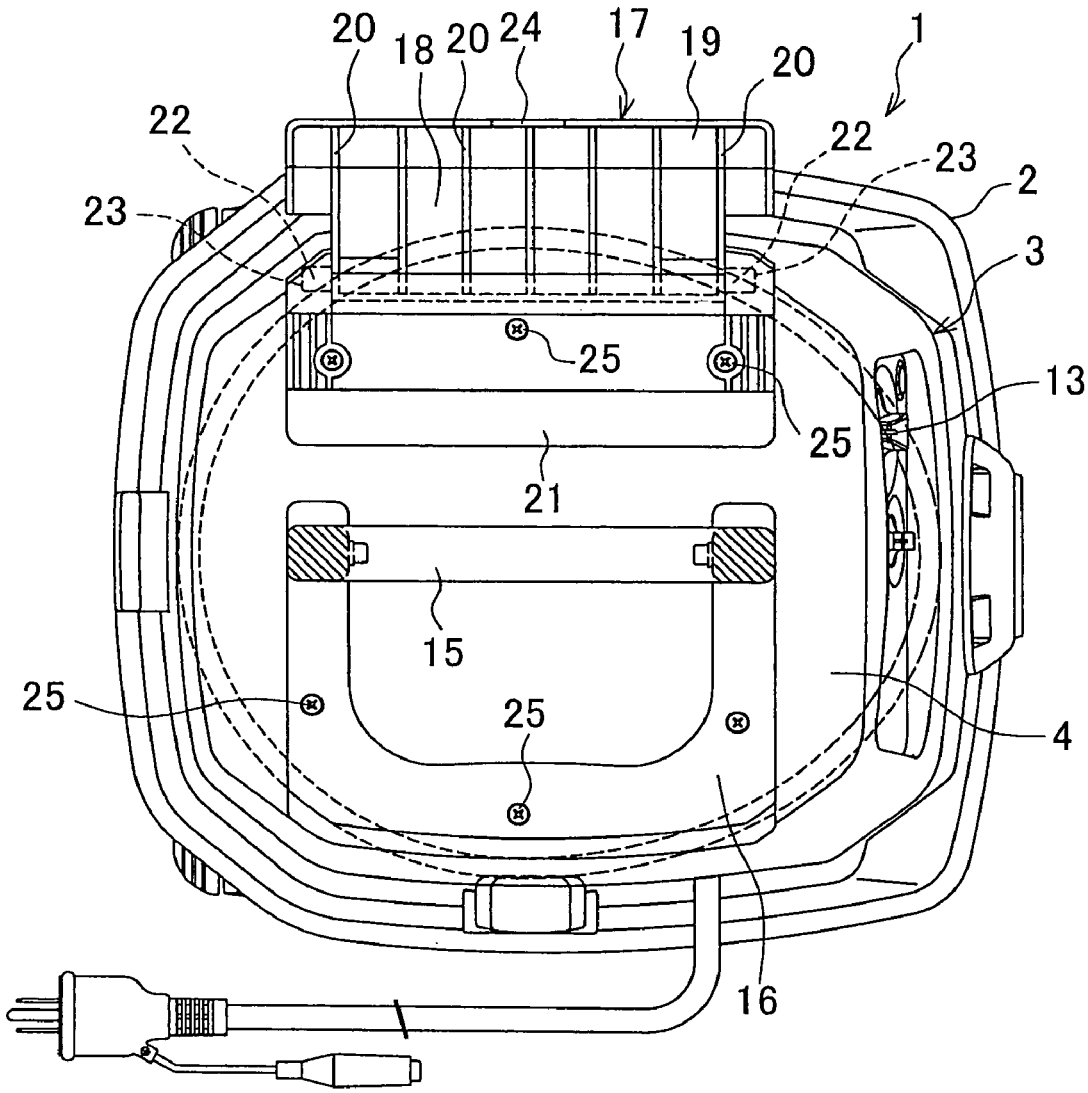
FIG. 2 is a plan view of the dust collector shown in FIG. 1.

Referring now to FIGS. 1 and 2, a dust collector 1 principally includes a tank 2, and a main body 3 disposed over the tank 2. The tank 2 has an opening formed at an upper side thereof, and an inlet (not shown) formed in a side wall thereof protrusively from the side wall outward. The main body 3 has a cowling 4 as one example of a housing, and an air intake unit 5 housed in the cowling 4. The main body 3 further has a tank cover 6, which is configured to seal off the opening of the tank 2 and to support the air intake unit 5 of the main body 3. The air intake unit 5 is disposed in the center of the opening of the tank 2, supported and suspended by the tank cover 6. The air intake unit 5 includes a motor 7, and intake fans 8 which can be driven by the motor 7 to rotate. The tank cover 6 has intake holes 9 provided just beneath the intake fans 8 at the bottom of the air intake unit 5. Denoted by reference numeral 10 is an air passage formed inside the main body 3 and communicating with the air intake unit 5. Denoted by reference numeral 11 is a cloth filter shaped like a bag and configured to be held between the tank cover 6 and the opening of the tank 2 and to intercept dust or the like, which would otherwise flow from the inlet to the air intake unit 5 while causing air to pass therethrough. Denoted by reference numeral 12 are casters provided at the bottom of the tank 2.

Figure 3:
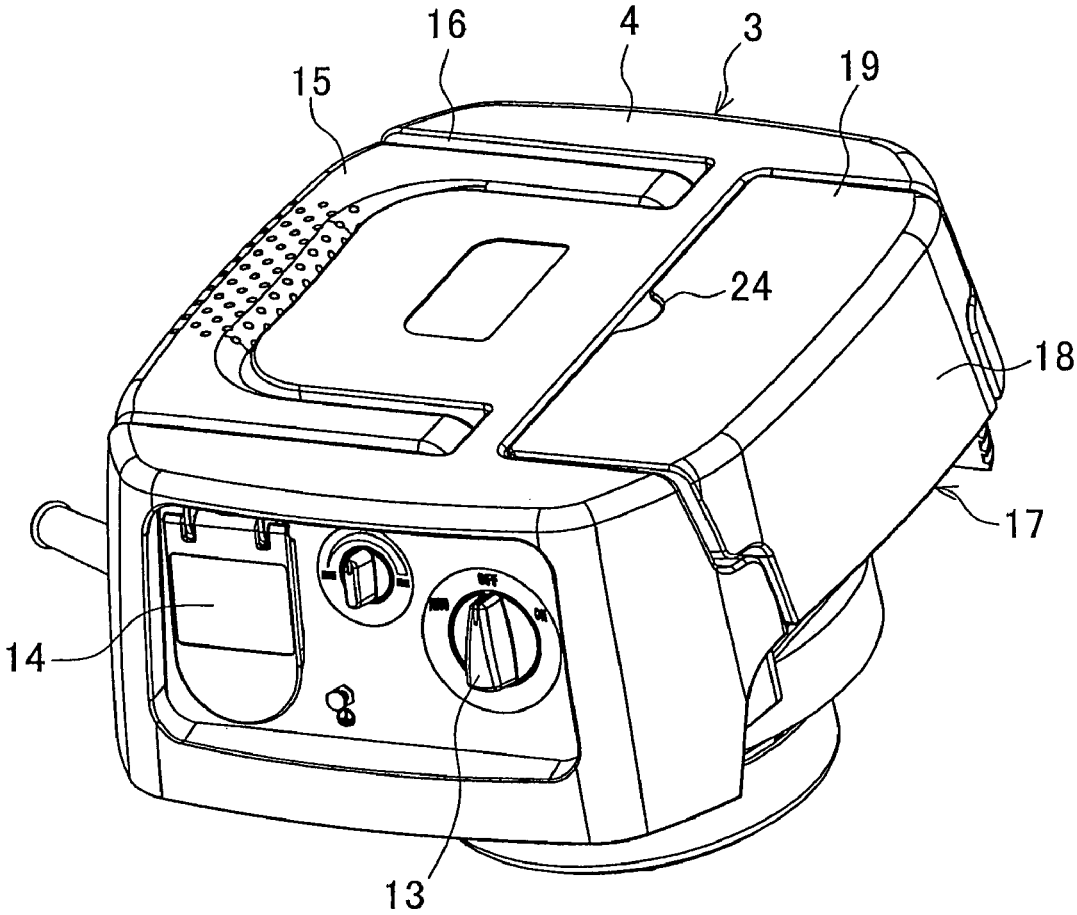
FIG. 3 is a perspective view of a main body of the dust collector with a hook in a retracted position.

The cowling 4 is shaped like a box with a flat upper surface; at a side surface thereof, as shown in FIG. 3, a rotary switch 13 for an operation selector with a dial, an interlock power socket 14 with a cap, and other components are provided. To the interlock power socket 14, a power cord of a power tool may be connected. At the center of an upper surface of the cowling 4, a U-shaped handle 15 is provided with both end thereof rotatably joined to the cowling 4. The handle 15 is configured to be rotatable between a retracted position (as indicated by solid lines in FIG. 1) and a pull-out position (as indicated by dashed lines in FIG. 1). The handle 15 in the retracted position is fitted in a recess 16 formed in the cowling 4 without projecting from the cowling 4; on this account, the recess 16 is contoured to fit the profile of the handle 15. The handle 15 in the pull-out position stands at the center of the upper surface of the cowling 4.

The main body 3 further has a hook 17 provided on a different side of the cowling 4 from the side of which the recess 16 is formed. The hook 17 is a plate member bent into a shape like a letter L, having a lower plate 18 and an upper plate 19. The lower plate 18 has an outer surface curved to conform with the shape of the side surface of the cowling 4. The upper plate 19 extends contiguously from an upper edge of the lower plate 18 in a direction perpendicular to the lower plate so as to form a hooked end portion, and has a flat outer surface, which conforms with the shape of the upper surface of the cowling 4. On the inner surfaces of the lower plate 18 and the upper plate 19, a plurality of ribs 20 are provided being parallel to one another along the inner surfaces of the both plates 18 and 19 at predetermined intervals.

Figure 4:
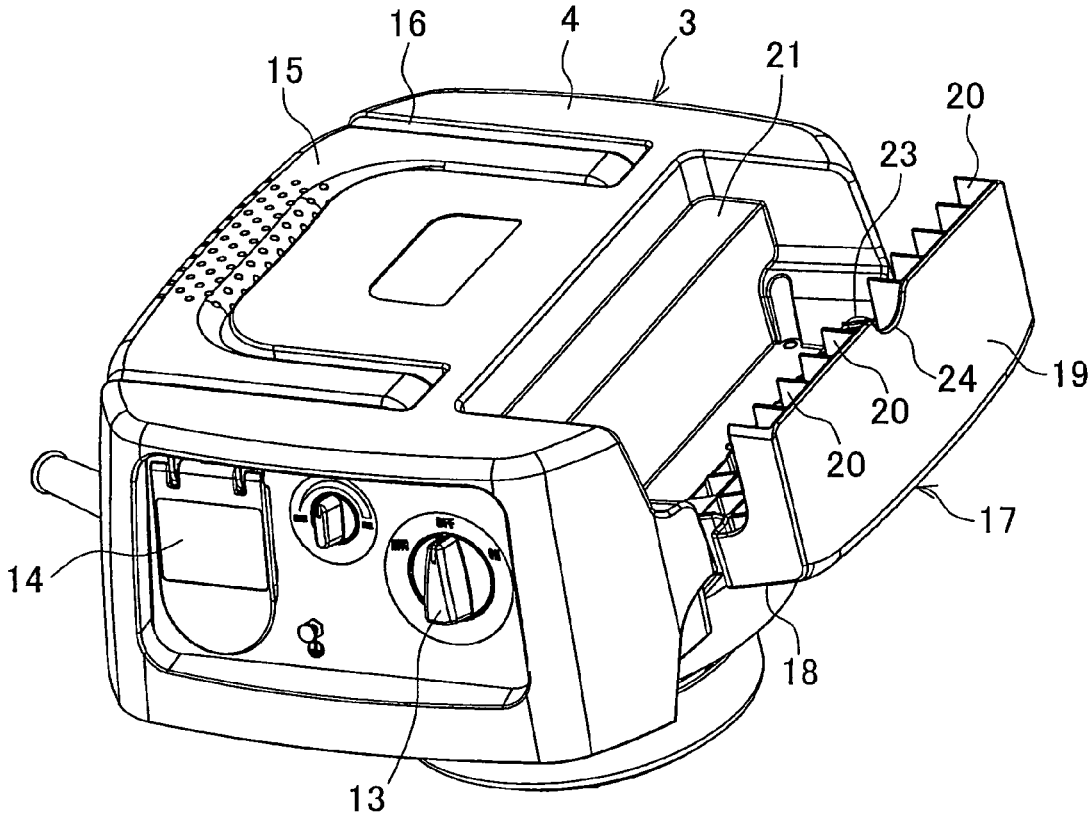
FIG. 4 is a perspective view of the main body of the dust collector with the hook in a pull-out position.
Figure 5:
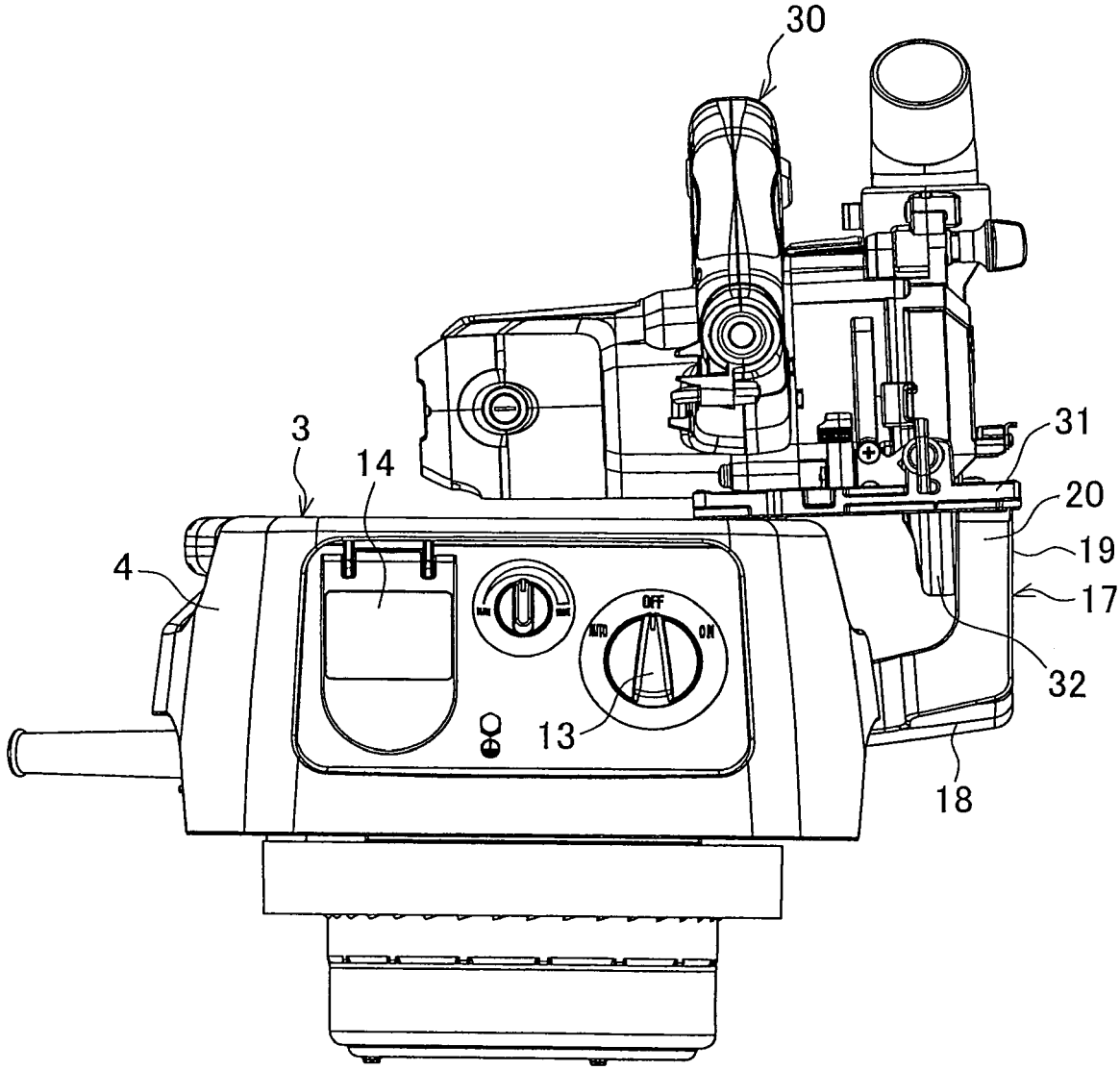
FIG. 5 is an elevation view of the main body of the dust collector illustrated with a circular saw placed temporarily thereon.

At an outer surface of the cowling 4, a trimmed portion 21 is provided which has a shape corresponding to that of the hook 17. On two opposed outer sides of a lower end portion of the lower plate 18, pins 22 are provided. On two opposed inside walls of the trimmed portion 21 (at the lower portion of the side wall of the housing), holding holes 23 for the pins 22 are provided. Accordingly, with the pins 22 fitted in the holding holes 23, respectively, the hook 17 is rendered rotatable between a retracted position (as indicated by solid lines in FIG. 1; see also FIG. 3) and a pull-out position (as indicated by dashed lines in FIG. 1; see also FIG. 4). Here, the retracted position is the position in which the hook 17 is tilted toward the cowling 4 and completely stored in the trimmed portion, while the pull-out position is the position in which the hook 17 projects sideward from the cowling 4 with the upper plate 19 oriented upward. In this pull-out position, upper end faces of the upper plate 19 and the ribs 20 are positioned parallel to the upper surface of the cowling 4, and kept slightly higher than that of the upper surface of the cowling 4.

Denoted by reference numeral 24 is a finger notch which is a recessed portion formed at the center of the inner edge of the upper plate 19 and configured to allow a finger to be inserted therein so that the operation of rotating the hook 17 from the retracted position to the pull-out position can be performed with increased ease.

At the bottom of the recess 16 for receiving the handle 15 and at the bottom of the trimmed portion 21 for receiving the hook 17, mounting screws 25 are provided, respectively, to mount the cowling 4 to the air intake unit 5 and the tank cover 6 by which the intake unit 5 is supported. These mounting screws 25 are arranged in such positions that they are hidden under the handle 15 and the hook 17 in their retracted positions while the mounting screws 25 are accessibly uncovered when the handle 15 and the hook 17 are in their pull-out positions. Therefore, when the cowling 4 needs to be removed for a repair of the air intake unit 5, the mounting screws 25 can easily be uncovered and unfastened; thus, the handle 15 and the hook 17 would not impair its easy serviceability.

With the dust collector 1 configured as described above, in operation, when the rotary switch 13 is turned ON and the motor 7 starts driving the intake fans 8 to rotate, outside air is sucked through a hose or the like attached to the inlet of the tank 2 into the tank 2, and passes through the filter 11; thereafter, the air having passed through the filter 11 is forwarded through the intake holes 9 to the air passage 10 inside the cowling 4, and then discharged through an air outlet (not shown) provided in the cowling 4 to the outside. During this suction process, any dust or dirt in the sucked air is caught in the filter 11, and stored in the tank 2. Therefore, when the hose attached to the inlet of the tank 2 is connected to a power tool such as a circular saw, chips produced during the use of the power tool can be directly collected through the hose without being scattered. The hook 17 may be stored in the retracted position when the dust collector 1 is in operation, so that the hook 17 is completely embedded in the trimmed portion 21 without projecting from the cowling 4 as described above, thus would never obstruct the operation.

Figure 6:
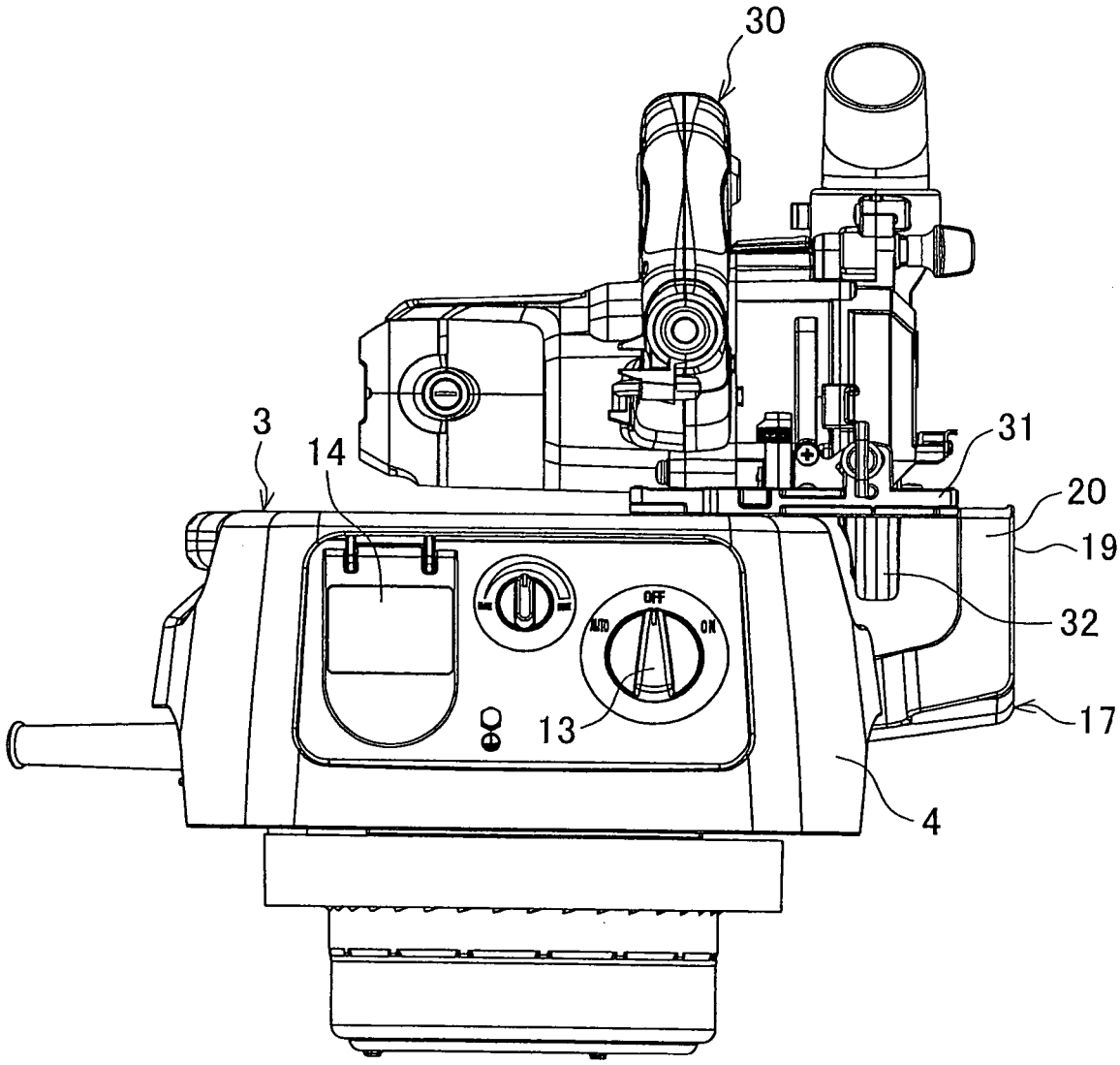
FIG. 6 is an elevation view of the main body of the dust collector illustrated with a circular saw placed temporarily thereon in a position different from that shown in FIG. 5.

In cases for example where a circular saw 30 is connected to the dust collector 1 and put into operation, when an operator suspends the operation and wishes to temporarily put the circular saw 30 down, the hook 17 may be pulled out into the pull-out position so that the circular saw 30 can be placed on the dust collector 1 with a base 31 put on the upper surface of the cowling 4 and on the end face of the upper plate 19. At that time, a safety cover 32 covering a saw blade which protrudes down below the base 31 fits in a space between the upper plate 19 of the hook 17 and the cowling 4. In this way, the circular saw 30 can be temporarily placed on the upper side of the main body 3. In particular, since the upper plate 19 protrudes upward beyond the upper surface of the cowling 4, the base 31 is tilted with its upper plate 19 side lifted up to some extent, and thus the potential risk of that the circular saw 30 drops from the outside edge of the main body 3 is reduced. However, depending upon the type of the circular saw 30, the circular saw 30 may be placed with the safety cover 32 put close to the cowling 4 and the majority portion of the base 31 may be laid on the upper surface of the cowling 4, as shown in FIG. 6.

Figure 7:
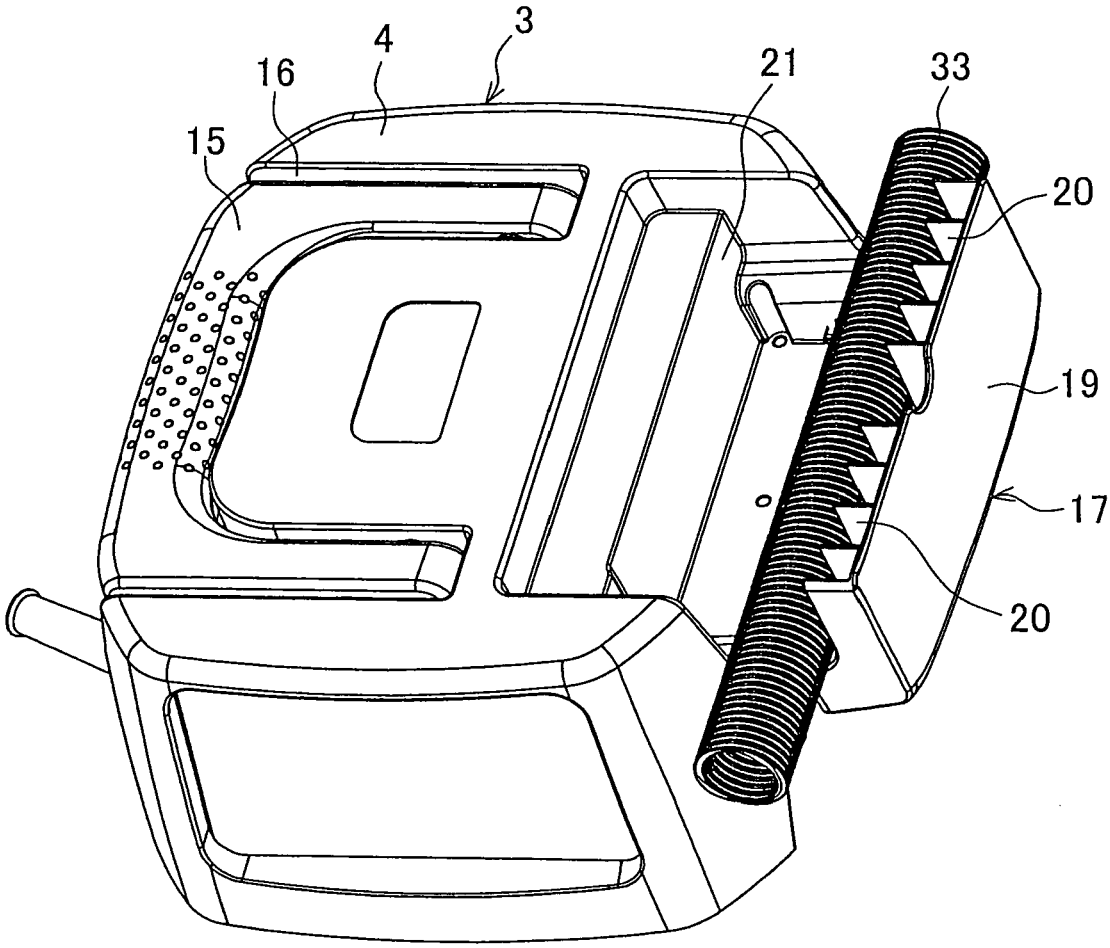
FIG. 7 is a perspective view of the main body of the dust collector illustrated with a hose held in the hook.

On the other hand, the hook 17 may serve any purpose other than that of temporarily placing a circular saw or other power tool thereon; for example, as shown in FIG. 7, an end portion of the hose 33, or other accessories such as a nozzle may be held between the upper plate 19 of the hook 17 and the cowling 4. In this way, the end portion of the hose 33 wound around the periphery of the dust collector 1 with its end opposite to the end portion being retained attached to the inlet of the dust collector 1 can be held by the hook 17, so that the hose 33 can be prevented from being untied and spread out. In particular, when the hose 33 is held by the hook 17, the ribs 20 of the upper plate 19 engage with the bellows of the hose 33 so as to prevent a slip of the hose 33; thus, the hose 33 is held with high degree of reliability. It is to be understood that accessorial components which can be held by the hook 17 are not limited to the hose; for example, the power cord(s) for the dust collector 1 and/or the power tool may be looped and tied up so as to be held in the hook 17.

As described above, in the dust collector 1 according to the present embodiment, the hook 17 capable of being manually operated to change a position thereof to one of the retracted position in which the hook 17 is completely embedded in the profile of the cowling 4 and the pull-out position in which the hook 17 projects sideward from the cowling 4 with the upper plate 19 oriented upward is provided in the cowling 4 of the main body 3. Therefore, the power tool can be temporarily placed on the upper side of the main body 3 in a stable state, and thus the usability can be improved. Moreover, the hook 17 can be used to hold a hose or a cord, etc. Furthermore, the hook 17 in the retracted position provides a storage space inside, such that accessories can be stored therein, which is highly convenient and useful.

In this embodiment, particularly, the ribs 20 which extend parallel to one another in an upward and downward direction when the hook 17 is in the pull-out position are provided on the inner surface of upper plate 19 facing toward the cowling 4. Therefore, the hook 17 is reinforced by the ribs 20, so that the durability of the hook 17 is increased, and prevention of slipping or dropping of the hose 33 or other accessories may be expected.

Moreover, in this embodiment, the upper plate 19 of the hook 17 is configured to have a length such that the upper plate 19 is higher than the upper surface of the cowling 4 when the hook 17 is in the pull-out position. In this configuration, the circular saw 30 can be supported in a position with its outer side tilting upward to some extent, and thus the potential risk of that the circular saw 30 temporarily placed thereon slips off and drops down outside from the main body 3 can be reduced.

Further in this embodiment, the cowling 4 is shaped like a box with a flat upper surface, and the hook 17 has a plate member bent into a shape like a letter L, wherein the plate member has a lower end joined to the main body 3 at a lower portion of the side wall of the cowling 4 in a manner that permits the plate member to tilt downward and upward. The hook 17 is capable of being operated to rotate between the retracted position and the pull-out position. Therefore, the operation for moving (rotating) the hook 17 between the retracted position and the pull-out position can be performed with increased ease.

The hook may be designed differently from the specific configuration illustrated above; for example, the ribs may be omitted while the thickness of the hook may be increased, instead; and the pins may be provided at the cowling side and fitted in the holding holes provided in the hook. Although the hook is shaped like a letter L composed of the lower and the upper plates in the above-described embodiment, a pair of L-shaped bars may be provided of which midpoints are connected by a bar to form the shape of a letter H. As long as a power tool can be stably supported by the hook in the pull-out position, the configuration of the hook is not limited to the above-described embodiment, but may be modified according to the shape of the housing or the like. Although a single hook is provided in the above-described embodiment, a plurality of hooks may be provided.

The invention claimed is:

1. A dust collector comprising:

a tank;

a main body disposed over the tank, the main body including:

a housing defining a recess and having an upper surface, and an air intake unit incorporated in the housing, and a handle provided at the upper surface of the housing, the handle being configured to be rotatable between a retracted position and a pull-out position, the handle in the retracted position being configured to fit in the recess defined by the housing without projecting from the housing; and a hook provided in the housing of the main body, and capable of being manually operated to change a position thereof to one of a retracted position and a pull-out position, wherein the hook in the retracted position is completely embedded in a profile of the housing, while the hook in the pull-out position projects sideward from the housing with a hooked end portion thereof oriented upward.

2. The dust collector according to claim 1, wherein the hook comprises a plurality of ribs provided on an inner surface of the hooked end portion facing toward the housing, the plurality of ribs extending parallel to one another in an upward and downward direction when the hook is in the pull-out position.

3. The dust collector according to claim 1, wherein the hooked end portion of the hook has a length such that the hooked end portion is higher than an upper surface of the housing when the hook is in the pull-out position.

4. The dust collector according to claim 2, wherein the hooked end portion of the hook has a length such that the hooked end portion is higher than an upper surface of the housing when the hook is in the pull-out position.

5. A dust collector comprising:

a tank;

a main body disposed over the tank, the main body comprising a housing and an air intake unit incorporated in the housing; and a hook provided in the housing of the main body, and capable of being manually operated to change a position thereof to one of a retracted position and a pull-out position, wherein the hook in the retracted position is completely embedded in a profile of the housing, while the hook in the pull-out position projects sideward from the housing with a hooked end portion thereof oriented upward, and the housing is shaped like a box with a flat upper surface, and the hook comprises a plate member bent into a shape like a letter L, and the plate member has a lower end joined to the main body at a lower portion of a side wall of the housing in a manner that permits the plate member to tilt downward and upward whereby the hook is capable of being operated to rotate between the retracted position and the pull-out position.

6. The dust collector according to claim 5, wherein the hook further comprises a pin provided at the lower end of the plate member, and the main body further comprises a holding hole provided at the lower portion of the side wall of the housing, the pin being disposed inside the holding hole whereby the hook is joined to the main body.

7. The dust collector according to claim 1, wherein the hook comprises a recessed portion provided at an edge of the hooked end portion and configured to allow a finger to be inserted therein.

8. The dust collector according to claim 1, wherein the main body further comprises a trimmed portion provided at an outer surface of the housing, the trimmed portion being configured to have a shape corresponding to that of the hook such that the hook in the retracted position is completely stored in the trimmed portion.

9. The dust collector according to claim 8, wherein the main body further comprises a mounting screw provided at a bottom surface of the trimmed portion to mount the housing to the air intake unit.

10. The dust collector according to claim 1, wherein the handle is provided at about a center of the upper surface of the housing in a position where the handle does not interfere with the hook, and the handle in the pull-out position stands at about the center of the upper surface of the housing.

11. The dust collector according to claim 10, wherein the handle is in U-shaped and both end thereof are rotatably joined to the housing.

12. The dust collector according to claim 10, wherein the main body further comprises a mounting screw provided at a bottom surface of the recess to mount the housing to the air intake unit.

* * * * *